US010549142B1

(12) United States Patent
Ash

(10) Patent No.: US 10,549,142 B1
(45) Date of Patent: Feb. 4, 2020

(54) CALF-STRETCHING DEVICE

(71) Applicant: Randall Ash, Muncie, IN (US)

(72) Inventor: Randall Ash, Muncie, IN (US)

( * ) Notice: Subject to any disclaimer, the term of this patent is extended or adjusted under 35 U.S.C. 154(b) by 114 days.

(21) Appl. No.: 15/949,196

(22) Filed: Apr. 10, 2018

(51) Int. Cl.
*A63B 21/00* (2006.01)
*A63B 23/10* (2006.01)
*A63B 21/002* (2006.01)

(52) U.S. Cl.
CPC ..... *A63B 21/4034* (2015.10); *A63B 21/0023* (2013.01); *A63B 21/00047* (2013.01); *A63B 23/10* (2013.01); *A63B 2225/09* (2013.01)

(58) Field of Classification Search
CPC ..... A63B 21/4034; A63B 21/0023; A63B 21/00047; A63B 23/10; A63B 2225/09
See application file for complete search history.

(56) References Cited

U.S. PATENT DOCUMENTS 3,284,819 A * 11/1966 Nissen ..... A47C 27/001 5/420
4,429,868 A * 2/1984 LeBlanc ..... A63B 23/03516 482/131
4,561,649 A * 12/1985 Forsythe ..... A47C 16/025 482/121
4,693,470 A * 9/1987 Ogawa ..... A63B 21/00047 482/79
5,056,507 A * 10/1991 Yum ..... A61H 7/001 601/136
5,087,036 A * 2/1992 Cooper ..... A63B 23/085 482/79
5,284,465 A * 2/1994 Homan, Jr. ..... A63B 21/00047 482/148
5,322,490 A * 6/1994 Van Der Hoeven ..... A63B 69/0022 472/90
5,518,476 A * 5/1996 McLeon ..... A63B 23/08 482/131
5,645,516 A * 7/1997 Foster ..... A63B 21/0004 482/121
5,897,464 A * 4/1999 Mcleod ..... A63B 23/08 482/132
6,244,992 B1 * 6/2001 James ..... A61H 1/0237 482/19
6,453,485 B2 * 9/2002 Bullock ..... A47K 3/002 4/580

(Continued)

FOREIGN PATENT DOCUMENTS

WO 2008026981 3/2008

*Primary Examiner* — Garrett K Atkinson
(74) *Attorney, Agent, or Firm* — Kyle A. Fletcher, Esq.

(57) ABSTRACT

The calf-stretching device is a mechanical apparatus. The calf-stretching device is configured for use by a patient. The calf-stretching device is configured for use in exercise. The patient uses the calf-stretching device to stretch the calf as a part of an exercise program. The calf-stretching device comprises a foot bed and a supporting structure. The supporting structure holds the foot bed at a stretch angle. The supporting structure is a rotating structure. The foot of the patient rests on the foot bed during use of the calf-stretching device. The foot rotates the supporting structure to vary the stretch angle of the foot bed during use of the calf-stretching device. The orientation of the foot bed within the supporting structure is adjustable such that the range of the stretch angle available to the patient over the exercise period can be adjusted.

17 Claims, 6 Drawing Sheets

(56) References Cited

U.S. PATENT DOCUMENTS

D473,272 S * 4/2003 Heins ..... D21/685
6,589,141 B1 * 7/2003 Flaggs ..... A63B 23/04 482/79
7,169,098 B1 * 1/2007 McGanty ..... A61H 1/0237 482/146
7,291,103 B1 * 11/2007 Estwanik ..... A61H 1/0237 482/148
7,635,321 B2 * 12/2009 Hill ..... A63B 21/00047 482/140
7,857,733 B2 * 12/2010 Tsakiris ..... A63B 21/00047 482/52
8,360,940 B2 * 1/2013 Kole ..... A63B 21/028 482/121
8,529,411 B2 * 9/2013 DiGiovanni ..... A63B 23/085 482/79
8,632,445 B2 * 1/2014 Kim ..... A63B 21/4035 482/142
9,114,278 B1 * 8/2015 Sigel ..... A63B 22/0694
9,364,382 B1 * 6/2016 Cooper ..... A61H 1/0237
9,566,470 B2 * 2/2017 Malizia ..... A61H 1/024
2004/0259704 A1 * 12/2004 Liang ..... A63B 22/16 482/146
2005/0014612 A1 * 1/2005 Sugiyama ..... A63B 21/00047 482/79
2005/0164845 A1 * 7/2005 DiGiovanni ..... A43B 3/00 482/79
2007/0037672 A1 * 2/2007 Nakanishi ..... A61H 1/0266 482/79
2007/0249476 A1 * 10/2007 Hill ..... A63B 21/00047 482/148
2008/0312051 A1 * 12/2008 Manyseng ..... A63B 9/00 482/92
2009/0270236 A1 * 10/2009 Berc ..... A47C 7/36 482/142
2010/0035734 A1 * 2/2010 DiGiovanni ..... A63B 23/085 482/79
2010/0234195 A1 * 9/2010 Koskela ..... A61H 1/0237 482/142
2011/0124473 A1 * 5/2011 Kole ..... A63B 21/028 482/79
2011/0269605 A1 * 11/2011 Kim ..... A63B 22/20 482/121
2014/0100086 A1 * 4/2014 Pagliaro ..... A61H 1/0237 482/91
2014/0274589 A1 * 9/2014 Harkins ..... A63B 21/0023 482/91
2016/0271443 A1 * 9/2016 Malizia ..... A61H 1/024
2018/0214733 A1 * 8/2018 DeNunzio ..... A63B 21/4039
2018/0271735 A1 * 9/2018 Drucker ..... A61H 1/02
2018/0318639 A1 * 11/2018 Kim ..... G06F 3/0334

* cited by examiner

CALF-STRETCHING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical science including stretching apparatus for exercise, more specifically, a stretching apparatus for a lower limb.

SUMMARY OF INVENTION

The calf-stretching device is a mechanical apparatus. The calf-stretching device is configured for use by a patient. The patient is further defined with a calf and a foot. The calf-stretching device is configured for use in exercise. The patient uses the calf-stretching device to stretch the calf as a part of an exercise program. The calf-stretching device comprises a foot bed and a supporting structure. The supporting structure holds the foot bed at a stretch angle. The supporting structure is a rotating structure. The foot of the patient rests on the foot bed during use of the calf-stretching device. The foot rotates the supporting structure to vary the stretch angle of the foot bed during use of the calf-stretching device. The orientation of the foot bed within the supporting structure is adjustable such that the range of the stretch angle available to the patient over the exercise period can be adjusted.

These together with additional objects, features and advantages of the calf-stretching device will be readily apparent to those of ordinary skill in the art upon reading the following detailed description of the presently preferred, but nonetheless illustrative, embodiments when taken in conjunction with the accompanying drawings.

In this respect, before explaining the current embodiments of the calf-stretching device in detail, it is to be understood that the calf-stretching device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the calf-stretching device.

It is therefore important that the claims be regarded as including such equivalent construction insofar as they do not depart from the spirit and scope of the calf-stretching device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
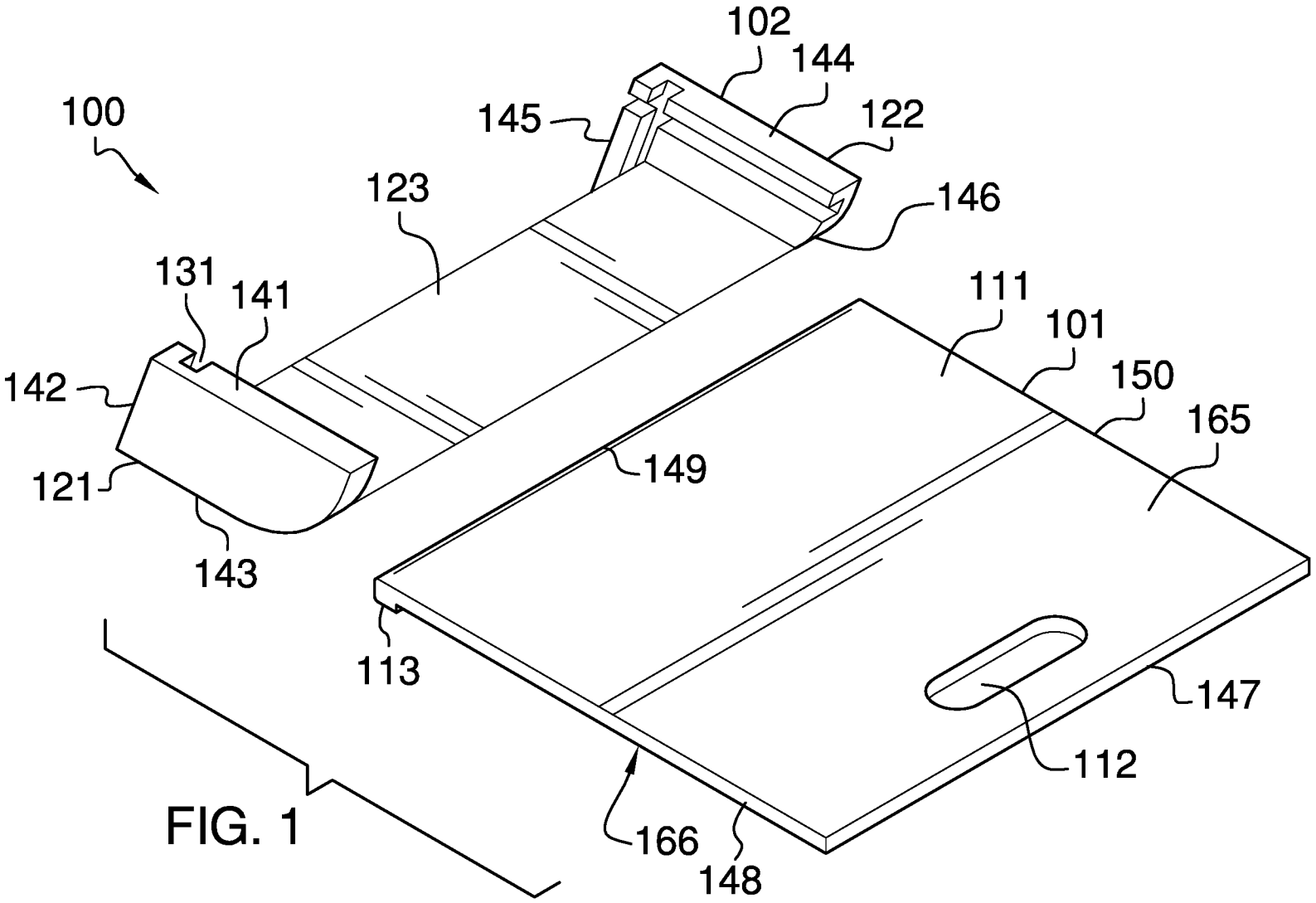
FIG. 1 is a perspective view of an embodiment of the disclosure.
Figure 2:
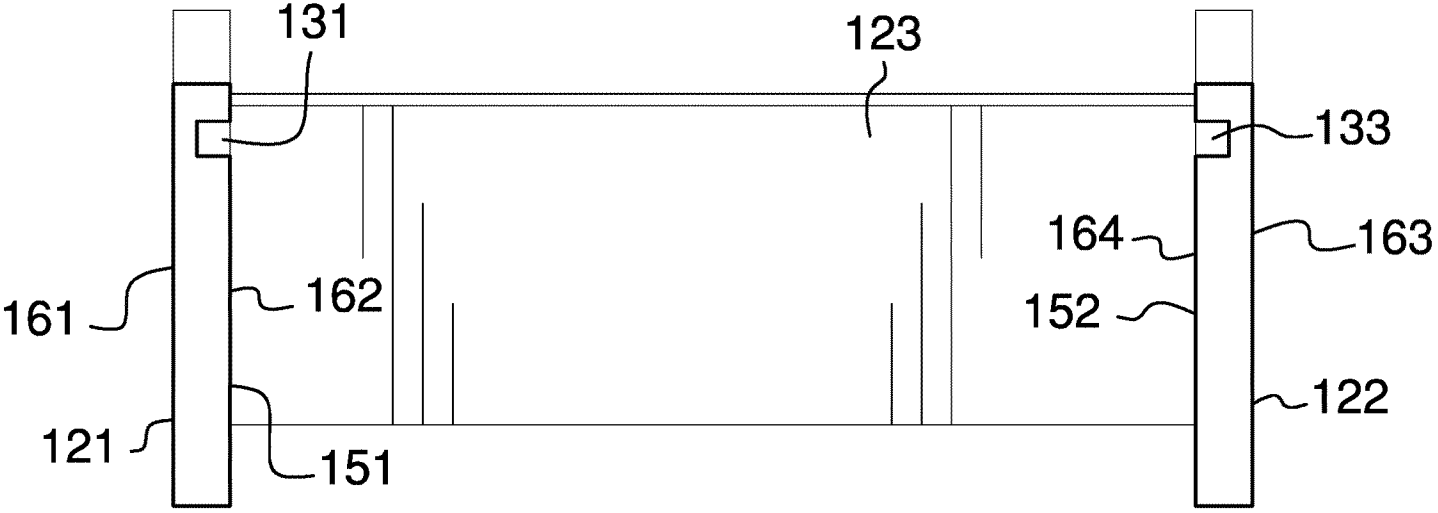
FIG. 2 is a top detail view of an embodiment of the disclosure.
Figure 3:
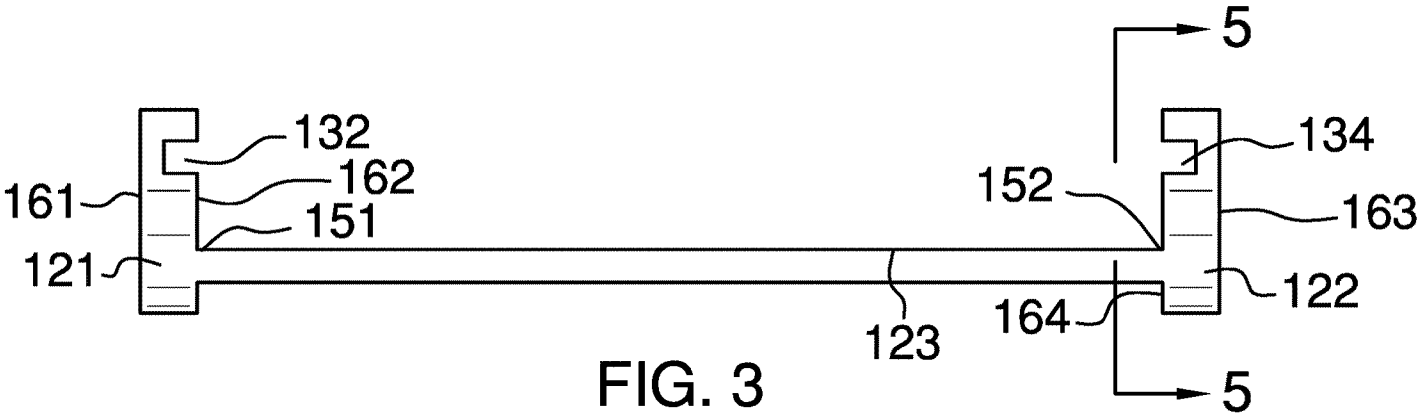
FIG. 3 is a front detail view of an embodiment of the disclosure.
Figure 4:
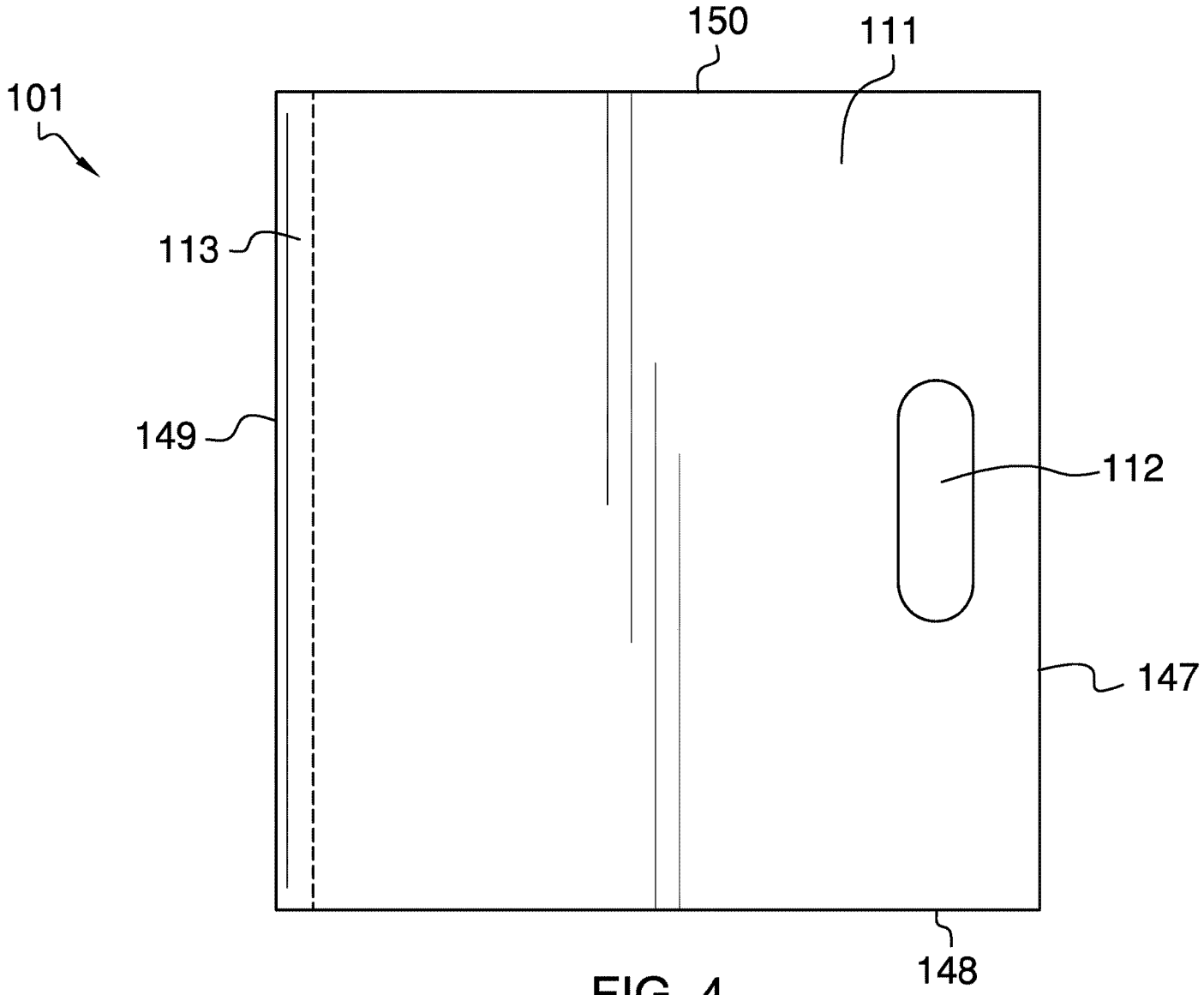
FIG. 4 is a top detail view of an embodiment of the disclosure.
Figure 6:
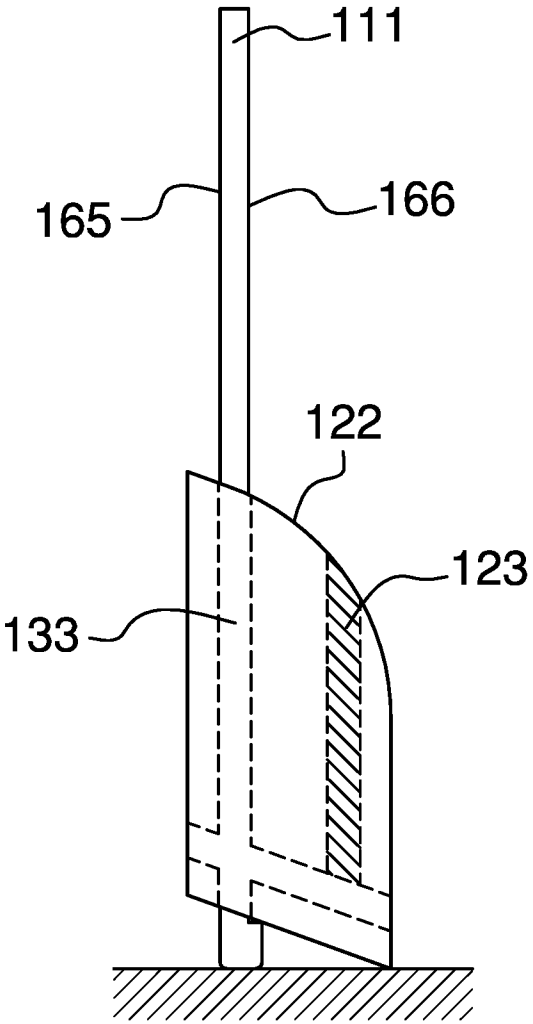
FIG. 6 is a side view of an embodiment of the disclosure.
Figure 5:
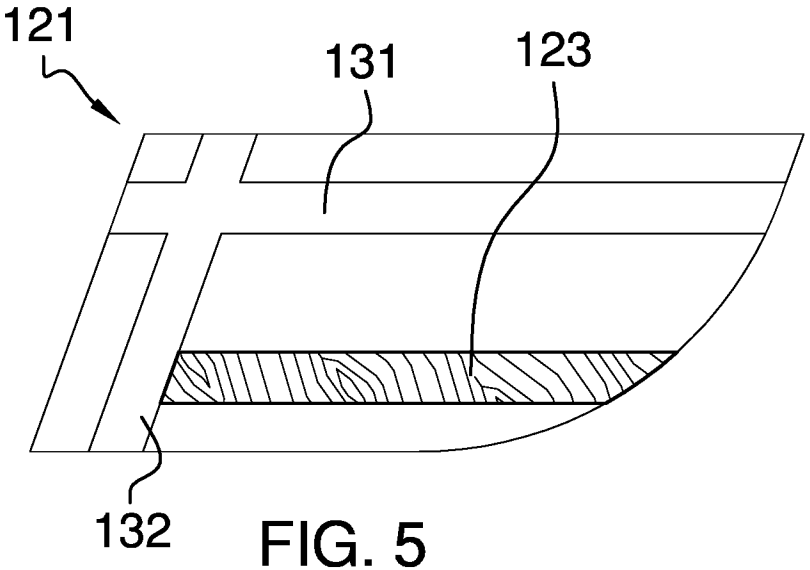
FIG. 5 is a cross-sectional view of an embodiment of the disclosure across 5-5 as shown in FIG. 3.
Figure 7:
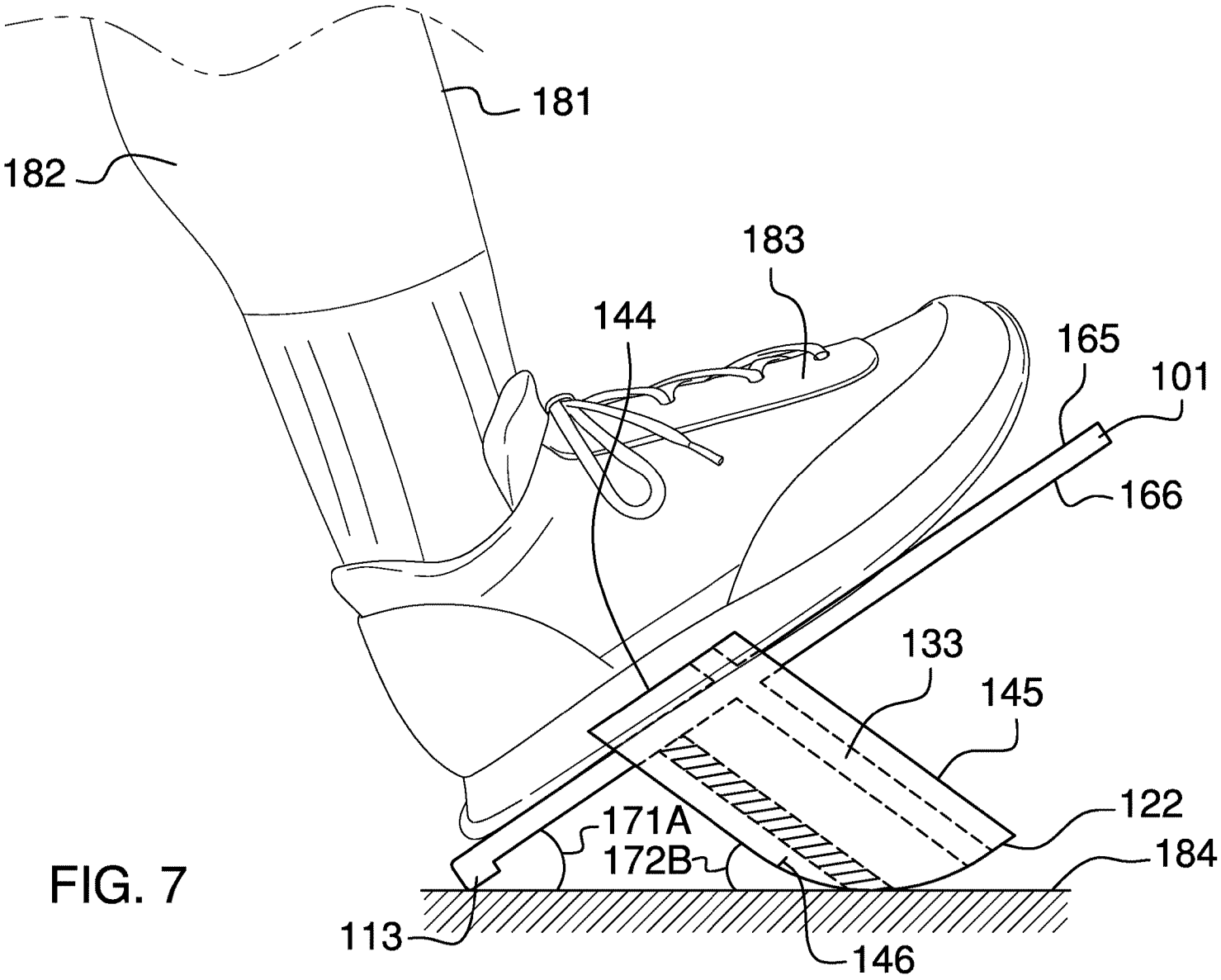
FIG. 7 is an in-use view of an embodiment of the disclosure.
Figure 8:
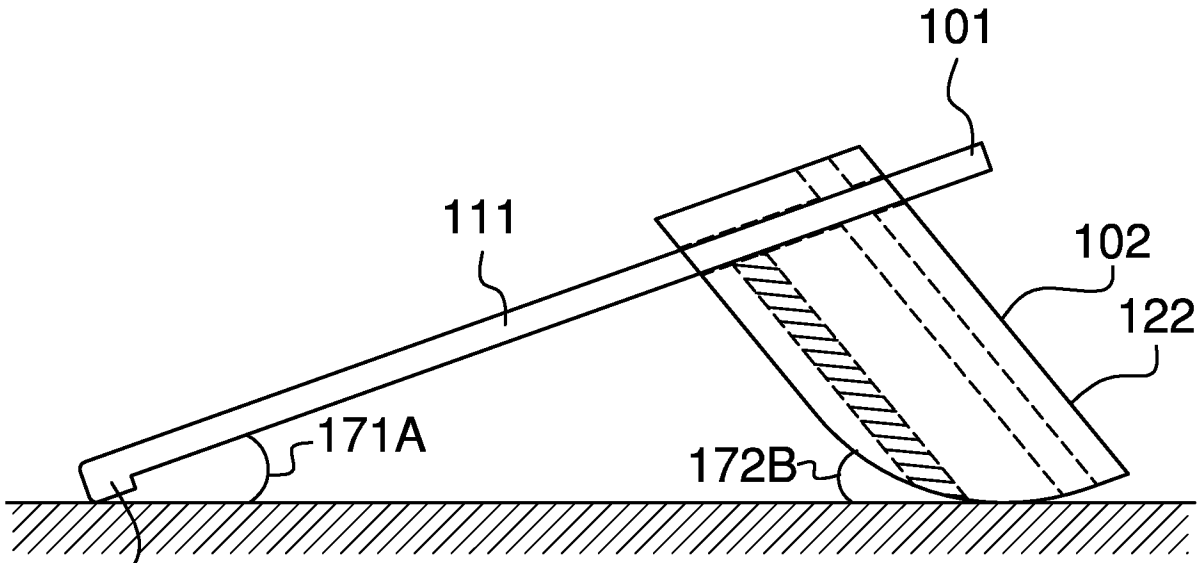
FIG. 8 is a side view of an embodiment of the disclosure.

Detailed reference will now be made to one or more potential embodiments of the disclosure, which are illustrated in FIGS. 1 through 8.

The calf-stretching device 100 (hereinafter invention) is a mechanical apparatus. The invention 100 is configured for use by a patient 181. The patient 181 is further defined with a calf 182 and a foot 183. The invention 100 is configured for use in exercise. The patient 181 uses the invention 100 to stretch the calf 182 as a part of an exercise program. The invention 100 comprises a foot 183 bed 101 and a supporting structure 102. The supporting structure 102 holds the foot 183 bed 101 at a stretch angle 171. The supporting structure 102 is a rotating structure. The foot 183 of the patient 181 rests on the foot 183 bed 101 during use of the invention 100. The foot 183 rotates the supporting structure 102 to vary the stretch angle 171 of the foot 183 bed 101 during use of the invention 100. The orientation of the foot 183 bed 101 within the supporting structure 102 is adjustable such that the range of the stretch angle 171 available to the patient 181 over the exercise period can be adjusted.

The foot 183 bed 101 forms a planar surface that rotates relative to the supporting surface 184 the invention 100 rests on. The foot 183 of the patient 181 simultaneously rests on the foot 183 bed 101 and the supporting surface 184. The calf 182 of the patient 181 stretches when the stretch angle 171 between the foot 183 bed 101 and the supporting surface 184 is changed by the foot 183. The foot 183 bed 101 is a plate. The foot 183 bed 101 has a rectangular shape.

The foot 183 bed 101 comprises a footplate 111, a grip 112, and a ridge 113. The foot 183 bed 101 is further defined with a stretch angle 171. The footplate 111 is further defined with a seventh edge 147, an eighth edge 148, and a ninth edge 149, and a tenth edge 150. The footplate 111 is further defined with a fifth surface 165 and a sixth surface 166. The ninth edge 149 is the edge of the footplate 111 that is distal from the seventh edge 147. The tenth edge 150 is the edge of the footplate 111 that is distal from the eighth edge 148. The fifth surface 165 is the surface of the footplate 111 that is distal from the sixth surface 166. The sixth surface 166 is the surface of the footplate 111 that is proximal to the supporting surface 184. The footplate 111 is a rectangular plate structure. The footplate 111 forms the primary structure of the foot 183 bed 101. The grip 112 is an aperture formed in the footplate 111. The grip 112 is a structure that allows the invention 100 to be carried. The ridge 113 is a rectangular block structure that attaches to the sixth surface 166 of the footplate 111. The ridge 113: a) prevents the footplate 111 from sliding along the supporting surface 184 during use of the invention 100; and, b) prevents the footplate 111 from sliding through the supporting structure 102 when the foot 183 bed 101 installs in the supporting structure 102.

The foot 183 bed 101 installs in the supporting structure 102. The supporting structure 102 is a rotating structure. The supporting structure 102 supports the foot 183 bed 101 at an angle relative to the supporting surface 184 called the stretch angle 171. The rotation of the supporting structure 102 allows the patient 181 to change the stretch angle 171 during use of the invention 100. The orientation of the installation of the foot 183 bed 101 into the supporting structure 102 can be changed to adjust the range of the stretch angle 171 available from the invention 100.

The supporting structure 102 comprises a first side board 121, a second side board 122, and an extension plate 123. The supporting structure 102 is further defined with a surface angle 172. The first side board 121 is further defined with a first edge 141, a second edge 142, and a third edge 143. The second side board 122 is further defined with a fourth edge 144, a fifth edge 145, and a sixth edge 146. The first side board 121 is further defined with a first surface 161 and a second surface 162. The second side board 122 is further defined with a third surface 163 and a fourth surface 164. The extension plate 123 is further defined with an eleventh edge 151 and a twelfth edge 152.

The first edge 141 and the second edge 142 are straight edges that form the right angle of the first side board 121. The third edge 143 forms a single curved edge of the first side board 121. The fourth edge 144 and the fifth edge 145 are straight edges that form the right angle of the second side board 122. The sixth edge 146 forms a single curved edge of the second side board 122.

The eleventh edge 151 is the edge of the extension plate 123 that is distal from the twelfth edge 152. The first surface 161 is the surface of the first side board 121 that forms the outer edge of the supporting structure 102. The second surface is the surface of the first side board 121 that is proximal to the second side board 122. The third surface 163 is the surface of the second side board 122 that forms the outer edge of the supporting structure 102. The fourth surface 164 is the surface of the second side board 122 that is proximal to the first side board 121.

The supporting structure 102 forms a surface angle 172 relative to the supporting surface 184. The rotation of the supporting structure 102 changes the surface angle 172 such that the stretch angle 171 will change in response. As shown most clearly in FIG. 7, the stretch angle 171, the surface angle 172 and the angle formed between the foot 183 bed 101 and the supporting structure 102 forms a triangle. Because the angle between the foot 183 bed 101 and the supporting structure 102 is fixed during use of the invention 100, the rotation of the supporting structure 102 causes a change in in the surface angle 172 of the supporting structure 102 which changes the stretch angle 171 between the foot 183 bed 101 and the supporting surface 184. Changing the orientation of the foot 183 bed 101 relative to the supporting structure 102 involves changing the angle between the foot 183 bed 101 and the supporting structure 102.

The extension plate 123 is a rectangular plate structure. The extension plate 123 forms an extension structure that separates the first side board 121 from the second side board 122.

The first side board 121 is a rounded rectangular block structure. In the first potential embodiment of the disclosure, a single vertex of the first side board 121 is rounded such that a single curved edge attaches the two vertices adjacent to the rounded vertex. The vertex of the first side board 121 that is distal from the rounded vertex is a right angle. The single curved edge of the first side board 121 is the third edge 143 of the first side board 121. The third edge 143 of the first side board 121 is formed in the shape of a segment of an ellipse. The right angle formed by the first edge 141 and the second edge 142 of the first side board 121 forms the focal point of the elliptical segment formed by the third edge 143. The applicant has found that the use of an elliptical segment for the shape of the third edge 143 of the first side board 121 provides the best overall performance of the invention 100.

The second side board 122 is a rounded rectangular block structure. In the first potential embodiment of the disclosure, a single vertex of the second side board 122 is rounded such that a single curved edge attaches the two vertices adjacent to the rounded vertex. The vertex of the second side board 122 that is distal from the rounded vertex is a right angle. The single curved edge of the second side board 122 is the sixth edge 146 of the second side board 122. The sixth edge 146 of the second side board 122 is formed in the shape of segment of an ellipse. The right angle formed by the fourth edge 144 and the fifth edge 145 of the second side board 122 forms the focal point of the elliptical segment formed by the sixth edge 146. The applicant has found that the use of an elliptical segment for the shape of the sixth edge 146 of the second side board 122 provides the best overall performance of the invention 100.

The first side board 121 further comprises a first slot 131 and a second slot 132. The second side board 122 further comprises a third slot 133 and a fourth slot 134.

The first slot 131 is a groove that is formed in the first side board 121 of the supporting structure 102. The third slot 133 is a groove that is formed in the second side board 122 of the supporting structure 102. The footplate 111 simultaneously inserts into the first slot 131 and the third slot 133 to form a first orientation of the foot 183 bed 101 to the supporting structure 102.

The second slot 132 is a groove that is formed in the first side board 121 of the supporting structure 102. The fourth slot 134 is a groove that is formed in the second side board 122 of the supporting structure 102. The footplate 111 simultaneously inserts into the second slot 132 and the fourth slot 134 to form a second orientation of the foot 183 bed 101 to the supporting structure 102.

The following four paragraphs describe spatial relationships in the first potential embodiment of the disclosure.

The inner diameter of the first slot 131, the second slot 132, the third slot 133, and the fourth slot 134 are identical. The span of the distance between the fifth surface 165 of the footplate 111 and the sixth surface 166 of the footplate 111 is less than the span of the inner diameter of the first slot 131 such that the footplate 111 inserts into any slot selected from the group consisting of the first slot 131, the second slot 132, the third slot 133, and the fourth slot 134.

The span of the combined distance between the fifth surface 165 and the sixth surface 166 plus the thickness of the ridge 113 is greater than the span of the distance of the inner diameter of the first slot 131 such that the ridge 113 will not insert into a slot selected from the group consisting of the first slot 131, the second slot 132, the third slot 133, and the fourth slot 134.

The span of the distance between the eighth edge 148 of the footplate 111 and the tenth edge 150 of the footplate 111 is less than the span of the distance between the first surface 161 of the first side board 121 and the third surface 163 of the second side board 122 such that the footplate 111 can simultaneously insert into a pair of slots selected from the group consisting of: a) the first slot 131 and the third slot 133; and, b) the second slot 132 and the fourth slot 134.

The perimeter of the first side board 121 formed by the first edge 141, the second edge 142, and the third edge 143 is geometrically identical to the perimeter of the second side board 122 formed by the fourth edge 144, the fifth edge 145, and the sixth edge 146. The third slot 133 and the fourth slot 134 are formed in the second side board 122 such that the third slot and the fourth slot 134 forms a mirror image of the first slot 131 and the second slot 132 of the first side board 121.

The following five paragraphs describe the assembly of the supporting structure 102.

The first slot 131 is formed in the second surface 162 of the first side board 121. The second slot 132 is formed in the second surface 162 of the first side board 121. The third slot 133 is formed in the fourth surface 164 of the second side board 122. The fourth slot 134 is formed in the fourth surface 164 of the second side board 122.

The first slot 131 of the first side board 121 is formed from the first edge 141 of the first side board 121 to the third edge 143 of the first side board 121. The second slot 132 of the first side board 121 is formed from the second edge 142 of the first side board 121 to the third edge 143 of the first side board 121. The third slot 133 of the second side board 122 is formed from the fourth edge 144 of the second side board 122 to the sixth edge 146 of the second side board 122. The fourth slot 134 of the second side board 122 is formed from the fifth edge 145 of the second side board 122 to the sixth edge 146 of the second side board 122.

The first slot 131 is formed such that the first slot 131 projects perpendicularly away from the first edge 141 of the first side board 121. The second slot 132 is formed such that the second slot 132 projects perpendicularly away from the second edge 142 of the first side board 121. The first slot 131 and the second slot 132 are perpendicular to each other.

The third slot 133 is formed such that the third slot 133 projects perpendicularly away from the fourth edge 144 of the second side board 122. The fourth slot 134 is formed such that the fourth slot 134 projects perpendicularly away from the fifth edge 145 of the second side board 122. The third slot 133 and the fourth slot 134 are perpendicular to each other.

The eleventh edge 151 of the extension plate 123 attaches to the second surface 162 of the first side board 121 such that the extension plate 123 projects perpendicularly away from the first side board 121. The twelfth edge 152 of the extension plate 123 attaches to the fourth surface 164 of the second side board 122 such that the extension plate 123 projects perpendicularly away from the second side board 122.

This paragraph describes the assembly of the foot 183 bed 101. The grip 112 is formed through the fifth surface 165 of the footplate 111 to the sixth surface 166 of the footplate 111. The major access of the oval shape of the grip 112 is parallel to the seventh edge 147 of the footplate 111. The ridge 113 aligns with the ninth edge 149 of the footplate 111 on the sixth surface 166 of the footplate 111.

The following two paragraphs describe the assembly and use of the invention 100.

The seventh edge 147 of the footplate 111 simultaneously inserts into a pair of slots selected from the group consisting of: a) the first slot 131 of the first side board 121 and the third slot 133 of the second side board 122; and, b) the second slot 132 of the first side board 121 and the fourth slot 134 of the third slot 133. The range of the available stretch angle 171 adjusts by changing the orientation of the foot 183 bed 101 relative to the supporting structure 102. The orientation of the foot 183 bed 101 relative to the supporting structure 102 adjusts by changing the selected pair of slots.

To use the invention 100, the assembled invention 100 is placed on the supporting surface 184 such that the third edge 143, the sixth edge 146, and the ridge 113 are in contact with the supporting surface 184. The heel of the foot 183 is placed on the supporting surface 184 while the ball of the foot 183 is placed on the fifth surface 165 of the footplate 111. The patient 181 uses the foot 183 to rotate the invention 100 around the third edge 143 and the sixth edge 146. This rotation of the invention 100 causes the calf 182 of the patient 181 to stretch.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Correspond: As used in this disclosure, the term correspond is used as a comparison between two or more objects wherein one or more properties shared by the two or more objects match, agree, or align within acceptable manufacturing tolerances.

Curve or Curvature: As used in this disclosure, a curve refers to a continuous line that is not a straight line or a continuous surface that is not a planar surface. By continuous is meant that the continuous line or surface changes smoothly over one or more independent variables. Alternately, continuous can be taken to mean that a single-valued derivative with respect to any independent variable exists for all points on the curved line or curved surface. A note on usage: within this disclosure, when a prism is said to be curved, what will be meant is that the center axis of the prism is curved. The discontinuities inherent in the ends of the prism will continue to exist in the lateral face of the curved prism.

Ellipse: As used in this disclosure, an ellipse is a curve described by the equation $(x/a)^2+(y/b)^2=c$.

Extension Structure: As used in this disclosure, an extension structure is an inert physical structure that is used to extend the span of the distance between any two objects.

Force of Gravity: As used in this disclosure, the force of gravity refers to a vector that indicates the direction of the pull of gravity on an object at or near the surface of the earth.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Hook: As used in this disclosure, a hook is an object that is curved or bent at an angle such that items can be hung on or caught by the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inner Dimension: As used in this disclosure, the term inner dimension describes the span from a first inside or interior surface of a container to a second inside or interior surface of a container. The term is used in much the same way that a plumber would refer to the inner diameter of a pipe.

Major and Minor Axes: As used in this disclosure, the major axis axes refer to a pair of perpendicular axis that are defined within a structure. The length of the major axis is always greater than or equal to the length of the minor axis.

Mirror Image: As used in this disclosure, a mirror image refers to a second object that is a reproduction of a first object wherein the second object is identical to the first object except that the orientation of the second object is reversed relative to the first object as if the second object has been reflected by a plane of a mirror (often called the mirror plane or plane of reflection).

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Orientation: As used in this disclosure, orientation refers to the positioning of a first object relative to: 1) a second object; or, 2) a fixed position, location, or direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Oval: As used in this disclosure, an oval is a geometric shape formed in the shape of a "squished" circle similar in form to an ellipse. The difference between an oval and an ellipse is that an ellipse can be described by a mathematical formula while an oval has no such description. The term ovoid refers to a three-dimensional structure with an oval shape that is analogous to the relationship of an ellipsoid and an ellipse.

Patient: As used in this disclosure, a patient is a person who is designated to receive a medical treatment, therapy or service.

Perimeter: As used in this disclosure, a perimeter is one or more curved or straight lines that bounds an enclosed area on a plane or surface. The perimeter of a circle is commonly referred to as a circumference.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk-like appearance.

Rectangular Block: As used in this disclosure, a rectangular block refers to a three-dimensional structure comprising six rectangular surfaces formed at right angles. Within this disclosure, a rectangular block may further comprise rounded edges and corners.

Ridge: As used in this disclosure, a ridge is a rectangular block structure attaches to and projects vertically away from away from a first surface.

Rounded: A used in this disclosure, the term rounded refers to the replacement of an apex, vertex, or edge or brink of a structure with a (generally smooth) curvature wherein the concave portion of the curvature faces the interior or center of the structure.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Slot: As used in this disclosure, a slot is a long narrow groove or aperture that is formed in an object.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Track: As used in this disclosure, a track is a structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS.

1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A therapeutic device comprising:
a foot bed and a supporting structure;
wherein the foot bed installs in the supporting structure;
wherein the supporting structure holds the foot bed at a stretch angle;
wherein the foot bed and the supporting structure forms an orientation;
wherein the supporting structure is a rotating structure;
wherein the therapeutic device is a mechanical apparatus;
wherein the therapeutic device is configured for use by a patient having a calf and a foot to stretch the calf;
wherein the therapeutic device rests on a supporting surface;
wherein the supporting structure comprises a first side board, a second side board, and an extension plate;
wherein the extension plate attaches the first side board to the second side board;
wherein the supporting structure is further defined with a surface angle;
wherein the first side board is further defined with a first edge, a second edge, and a third edge;
wherein the second side board is further defined with a fourth edge, a fifth edge, and a sixth edge;
wherein the first side board is further defined with a first surface and a second surface;
wherein the second side board is further defined with a third surface and a fourth surface;
wherein the foot bed comprises a footplate, a grip, and a ridge;
wherein the grip is formed in the footplate;
wherein the ridge attaches to the footplate;
wherein the foot bed is further defined with a stretch angle;
wherein the footplate is further defined with a seventh edge, an eighth edge, and a ninth edge, and a tenth edge;
wherein the footplate is further defined with a fifth surface and a sixth surface;
wherein the extension plate is further defined with an eleventh edge and a twelfth edge;
wherein the first side board is a rounded rectangular block structure;
wherein a single vertex of the first side board is rounded such that the third edge attaches the two vertices adjacent to the rounded vertex;
wherein the vertex of the first side board that is distal from the rounded vertex is the first right angle;
wherein the second side board is a rounded rectangular block structure;
wherein a single vertex of the second side board is rounded such that the sixth edge attaches the two vertices adjacent to the rounded vertex;
wherein the vertex of the second side board that is distal from the rounded vertex is the second right angle.

2. The therapeutic device according to claim 1
wherein the supporting structure is a rotating structure;
wherein the supporting structure is further defined with a surface angle;
wherein the rotation of the supporting structure changes the stretch angle;
wherein the supporting structure is adapted to be rotated by the foot of the patient;
wherein the orientation of the foot bed within the supporting structure is adjustable;
wherein the range of the stretch angle adjusts by adjusting the orientation between the foot bed and the supporting structure.

3. The therapeutic device according to claim 2
wherein the foot bed is a plate;
wherein the foot bed has a rectangular shape;
wherein the foot bed forms a planar surface that rotates relative to the supporting surface.

4. The therapeutic device according to claim 3
wherein the footplate is a rectangular plate structure;
wherein the grip is an aperture formed in the footplate;
wherein the ridge is a rectangular block structure that attaches to the sixth surface of the footplate;
wherein the ridge prevents the footplate from sliding along the supporting surface;
wherein the ridge prevents the footplate from sliding through the supporting structure.

5. The therapeutic device according to claim 4
wherein the first edge and the second edge are straight edges that form a first right angle;
wherein the third edge forms a single curved edge of the first side board;
wherein the fourth edge and the fifth edge are straight edges that form a second right angle;
wherein the sixth edge forms a single curved edge of the second side board.

6. The therapeutic device according to claim 5
wherein the stretch angle, the surface angle and the angle formed between the foot bed and the supporting structure forms a triangle;
wherein the rotation of the supporting structure causes a change in in the surface angle of the supporting structure which changes the stretch angle between the foot bed and the supporting surface;
wherein changing the orientation of the foot bed relative to the supporting structure involves changing the angle between the foot bed and the supporting structure.

7. The therapeutic device according to claim 6
wherein the extension plate is a rectangular plate structure;
wherein the extension plate forms an extension structure that separates the first side board from the second side board.

8. The therapeutic device according to claim 7
wherein the third edge of the first side board is formed in the shape of a segment of an ellipse;
wherein the first right angle forms the focal point of the elliptical segment formed by the third edge;
wherein the sixth edge of the second side board is formed in the shape of a segment of an ellipse;
wherein the second right angle forms the focal point of the elliptical segment formed by the sixth edge.

9. The therapeutic device according to claim 8
wherein the first side board further comprises a first slot and a second slot;

wherein the second side board further comprises a third slot and a fourth slot;

wherein the first slot is a groove that is formed in the first side board of the supporting structure;

wherein the third slot is a groove that is formed in the second side board of the supporting structure;

wherein the second slot is a groove that is formed in the first side board of the supporting structure;

wherein the fourth slot is a groove that is formed in the second side board of the supporting structure.

10. The therapeutic device according to claim 9 wherein the footplate simultaneously inserts into the first slot and the third slot to form a first orientation of the foot bed to the supporting structure;

wherein the footplate simultaneously inserts into the second slot and the fourth slot to form a second orientation of the foot bed to the supporting structure.

11. The therapeutic device according to claim 10 wherein the inner diameter of the first slot, the second slot, the third slot, and the fourth slot are identical;

wherein the span of the distance between the fifth surface of the footplate and the sixth surface of the footplate is less than the span of the inner diameter of the first slot such that the footplate inserts into any slot selected from the group consisting of the first slot, the second slot, the third slot, and the fourth slot;

wherein the span of the combined distance between the fifth surface and the sixth surface plus the thickness of the ridge is greater than the span of the distance of the inner diameter of the first slot such that the ridge will not insert into a slot selected from the group consisting of the first slot, the second slot, the third slot, and the fourth slot.

12. The therapeutic device according to claim 11 wherein the span of the distance between the eighth edge of the footplate and the tenth edge of the footplate is less than the span of the distance between the first surface of the first side board and the third surface of the second side board such that the footplate can simultaneously insert into a pair of slots selected from the group consisting of: a) the first slot and the third slot; and, b) the second slot and the fourth slot.

13. The therapeutic device according to claim 12 wherein the perimeter of the first side board formed by the first edge, the second edge, and the third edge is geometrically identical to the perimeter of the second side board formed by the fourth edge, the fifth edge, and the sixth edge;

wherein the third slot and the fourth slot are formed in the second side board such that the third slot and the fourth slot forms a mirror image of the first slot and the second slot of the first side board.

14. The therapeutic device according to claim 13 wherein the first slot is formed in the second surface of the first side board;

wherein the second slot is formed in the second surface of the first side board;

wherein the third slot is formed in the fourth surface of the second side board;

wherein the fourth slot is formed in the fourth surface of the second side board;

wherein the first slot of the first side board is formed from the first edge of the first side board to the third edge of the first side board;

wherein the second slot of the first side board is formed from the second edge of the first side board to the third edge of the first side board;

wherein the third slot of the second side board is formed from the fourth edge of the second side board to the sixth edge of the second side board;

wherein the fourth slot of the second side board is formed from the fifth edge of the second side board to the sixth edge of the second side board;

wherein the first slot is formed such that the first slot projects perpendicularly away from the first edge of the first side board;

wherein the second slot is formed such that the second slot projects perpendicularly away from the second edge of the first side board;

wherein the first slot and the second slot are perpendicular to each other;

wherein the third slot is formed such that the third slot projects perpendicularly away from the fourth edge of the second side board;

wherein the fourth slot is formed such that the fourth slot projects perpendicularly away from the fifth edge of the second side board;

wherein the third slot and the fourth slot are perpendicular to each other.

15. The therapeutic device according to claim 14 wherein the eleventh edge of the extension plate attaches to the second surface of the first side board such that the extension plate projects perpendicularly away from the first side board;

wherein the twelfth edge of the extension plate attaches to the fourth surface of the second side board such that the extension plate projects perpendicularly away from the second side board.

16. The therapeutic device according to claim 15 wherein the grip is formed through the fifth surface of the footplate to the sixth surface of the footplate;

wherein the major access of the oval shape of the grip is parallel to the seventh edge of the footplate;

wherein the ridge aligns with the ninth edge of the footplate on the sixth surface of the footplate.

17. The therapeutic device according to claim 16 wherein the seventh edge of the footplate simultaneously inserts into a pair of slots selected from the group consisting of: a) the first slot of the first side board and the third slot of the second side board; and, b) the second slot of the first side board and the fourth slot of the third slot.

* * * * *